US009756943B2

(12) United States Patent
Lee

(10) Patent No.: US 9,756,943 B2
(45) Date of Patent: Sep. 12, 2017

(54) CABINET SYSTEM WITH AFFIXIBLE FACINGS

(71) Applicant: Michael F. Lee, Danville, VA (US)

(72) Inventor: Michael F. Lee, Danville, VA (US)

( * ) Notice: Subject to any disclaimer, the term of this patent is extended or adjusted under 35 U.S.C. 154(b) by 0 days.

(21) Appl. No.: 15/060,853

(22) Filed: Mar. 4, 2016

(65) Prior Publication Data

US 2017/0224115 A1 Aug. 10, 2017

Related U.S. Application Data

(60) Provisional application No. 62/292,149, filed on Feb. 5, 2016.

(51) Int. Cl.

| | |
|---|---|
| ***A47B 96/00*** | (2006.01) |
| ***A47B 96/20*** | (2006.01) |
| ***A47B 77/00*** | (2006.01) |
| ***A47B 67/02*** | (2006.01) |
| ***A47B 95/04*** | (2006.01) |

(52) U.S. Cl.

CPC ..... *A47B 96/201* (2013.01); *A47B 67/02* (2013.01); *A47B 77/00* (2013.01); *A47B 95/043* (2013.01); *A47B 2095/046* (2013.01)

(58) Field of Classification Search

CPC ..... A47B 96/201; A47B 2096/204; A47B 2096/207; A47B 77/00; A47B 95/00; A47B 95/04; A47B 95/043; A47B 2095/046

See application file for complete search history.

(56) References Cited

U.S. PATENT DOCUMENTS

| | | | | |
|---|---|---|---|---|
| 3,826,551 | A * | 7/1974 | Schwartz | A47B 96/201 312/140 |
| 5,100,216 | A * | 3/1992 | Enns | A47B 47/0025 108/180 |
| 6,063,475 | A * | 5/2000 | Ciancio | A47B 13/083 248/345.1 |
| 6,840,773 | B2 * | 1/2005 | Anderson | B44C 3/02 434/72 |
| 9,185,981 | B1 * | 11/2015 | Kane | A47B 95/04 |
| 2008/0042531 | A1 * | 2/2008 | Livingston | A47B 47/0091 312/204 |
| 2008/0224586 | A1 * | 9/2008 | Yamada | A47B 95/04 312/348.4 |
| 2009/0000237 | A1 * | 1/2009 | Borgman | A47B 96/201 52/716.1 |
| 2009/0179534 | A1 * | 7/2009 | Chen | E05B 65/466 312/221 |
| 2012/0223628 | A1 * | 9/2012 | Evangelidis | A47B 88/0044 312/326 |
| 2014/0205779 | A1 * | 7/2014 | Lin | A47B 95/043 428/35.6 |
| 2016/0235192 | A1 * | 8/2016 | Kramer | B29C 65/4865 |

* cited by examiner

*Primary Examiner* — Daniel Rohrhoff

(74) *Attorney, Agent, or Firm* — Schwabe, Williamson & Wyatt, P.C.

(57) ABSTRACT

A cabinet system having worksite-affixable facings, including components for a cabinet frame. The cabinet frame including a left side panel, a right side panel, a bottom panel having, a front top panel, and optionally, a back panel. The cabinet system further includes at least two side facings, at least one top facing, and at least one bottom facing, affixable, respectively, to the front edge of the left side panel, the front edge of the right side panel, the front edge of the bottom panel, and the front edge of the front top panel with a hidden fastening system.

9 Claims, 12 Drawing Sheets

CABINET SYSTEM WITH AFFIXIBLE FACINGS

CROSS-REFERENCE TO RELATED APPLICATION

This application claims the priority benefit of the earlier filing date of U.S. Provisional Patent Application No. 62/292,149, filed Feb. 5, 2016, which is incorporated herein by reference in its entirety.

TECHNICAL FIELD

Embodiments relate to frameless cabinets with facings that can be affixed in the field and/or may be removable and replaceable.

BACKGROUND

Cabinets, such as kitchen or bathroom cabinets, are ubiquitous in the modern home. Typically, a cabinet body is built as a box, into which drawers, shelving, and the like are placed or affixed. Multiple cabinets can be placed or strung together to create a cabinet run as is typically seen under the counter in a kitchen. Cabinets are typically built as a box having a bottom, two sides, at least a partial back, and at least a partial top stretching between the top ends of the two sides resting on a toe base or toe kick. There are two main types of cabinets, face frame and frameless (also called European). In a traditional face frame cabinet, the sides, bottom and top of the cabinets include, on their front face, a thick piece of wood, or other material and the door or drawer fronts of the cabinets are configured to fit flush with this front face when closed. Frameless cabinets do not have this front face and the cabinet door and/or drawers extend over the forward edges of the sides, bottom and top, resting against these forward edges, with a slight gap between the faces or adjacent doors and drawer fronts.

BRIEF DESCRIPTION OF THE DRAWINGS

Embodiments will be readily understood by the following detailed description in conjunction with the accompanying drawings. Embodiments are illustrated by way of example and not by way of limitation in the figures of the accompanying drawings.

DETAILED DESCRIPTION OF DISCLOSED EMBODIMENTS

Figure 1:
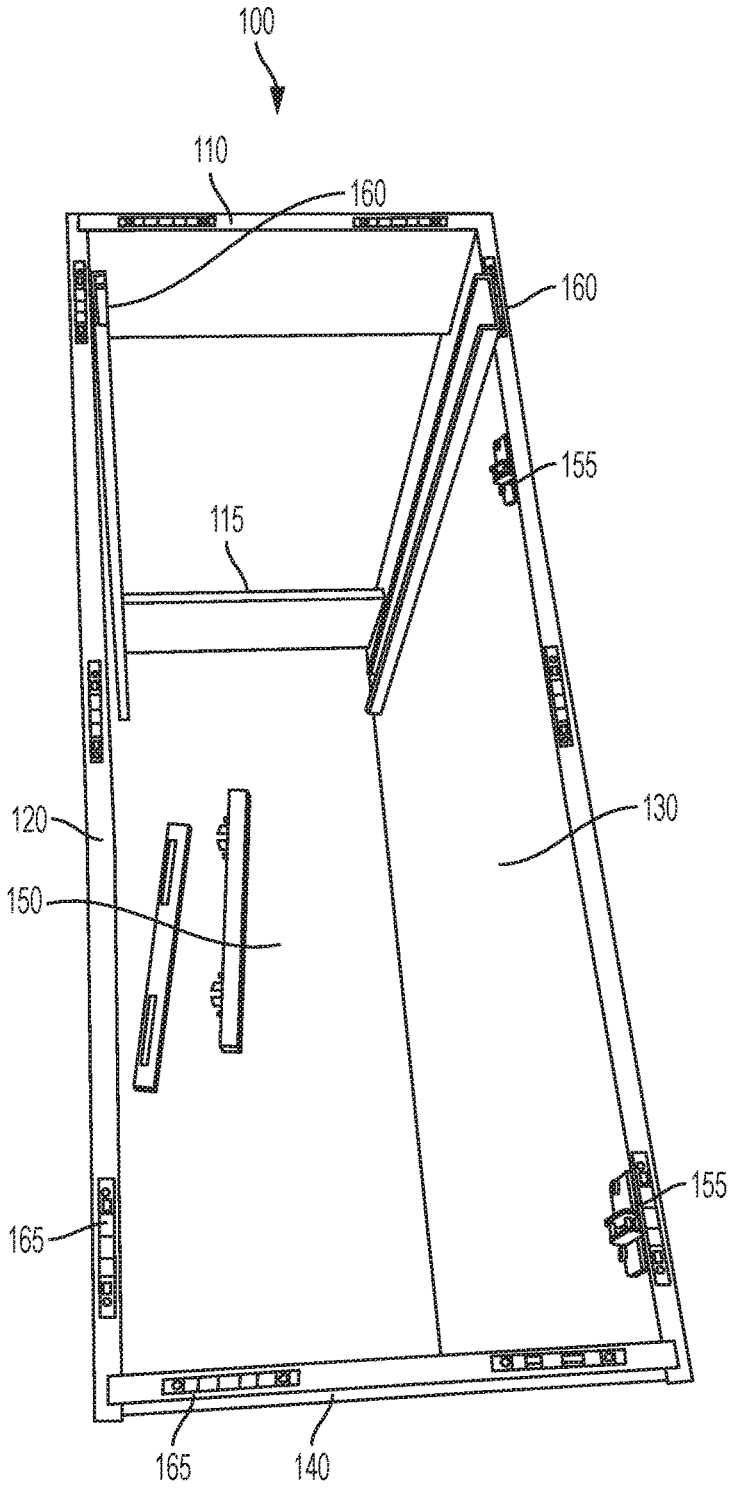
FIG. 1 is a front perspective view of a base cabinet box, in accordance with embodiments disclosed herein.

In the following detailed description, reference is made to the accompanying drawings which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense, and the scope of embodiments is defined by the appended claims and their equivalents.

Various operations may be described as multiple discrete operations in turn, in a manner that may be helpful in understanding embodiments; however, the order of description should not be construed to imply that these operations are order dependent.

The description may use perspective-based descriptions such as up/down, back/front, and top/bottom. Such descriptions are merely used to facilitate the discussion and are not intended to restrict the application of disclosed embodiments.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

For the purposes of the description, a phrase in the form "A/B" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the terms "embodiment" or "embodiments," which may each refer to one or more of the same or different embodiments. Furthermore, the terms "comprising," "including," "having," and the like, as used with respect to embodiments, are synonymous.

For the purposes of promoting an understanding of the principles of the disclosure, reference will now be made to the embodiments illustrated in the drawings and specific language will be used to describe the same. It will nevertheless be understood that no limitation of the scope of the claims is thereby intended. Any such alterations and further modifications in the illustrated device, and any such further applications of the principles as illustrated herein, are contemplated as would normally occur to one skilled in the art to which the disclosure relates.

Disclosed is a faceless cabinet system, with facings or fascia that can be applied in the field, for example, during or before cabinet installation. In some embodiments, the facings are permanently affixed to the cabinet. In some embodiments, the facings are removable, replaceable, and/or exchangeable facings, for example, exchangeable with different facings, such as different materials and/or colors. The disclosed faceless cabinet system may be upper cabinet or a base cabinet, or even a wall cabinet. In some embodiments, the cabinet is a kitchen cabinet. In other embodiments, the cabinet is a bathroom cabinet. In still other embodiments, the cabinet is a garage cabinet.

The disclosed faceless cabinet system may include the components for a cabinet frame, which includes: a left side panel having a top edge, a bottom edge, a front edge, and a rear edge; a right side panel, having a top edge, a bottom edge, a front edge, and a rear edge: a bottom panel having a front edge, rear edge, and side edges; a front top panel having a front edge, rear edge and side edges; and optionally, a back panel having a top edge, a bottom edge, and side edges. When assembled, the components form a box enclosing an interior volume, with a generally open front (where drawer fronts and drawers would be located) and having both interior surfaces and exterior surfaces. When assembled, the left side panel is opposite the right side panel, the side edges of the bottom panel are disposed between the bottom edge of the left side panel and the bottom edge of the right side panel, for example, in a rabbet partially extending into the side panels, the side edges of the front top panel are disposed between the top edge of the left side panel and the top edge of the right side panel, for example, in a rabbet partially extending into the side panels, and the side edges of the optional rear panel disposed between the rear edge of the left side panel and the rear edge of the right side panel, for example, in a groove, dado, or rabbet. In some embodiments, the components of the cabinet box are unassembled, for example, for shipping, such as flat panel shipping. In some embodiments, the components of the cabinet box are assembled. In some examples, the boxes are assembled on site.

In some embodiments, the disclosed faceless cabinet system includes at least two side facings (for example, a left side facing and a right side facing), at least one top facing, and at least one bottom facing. The at least two side facings, the at least one top facing, and the at least one bottom facing are configured, in conjunction with the respective front edges, to be affixable to the front edge of the left side panel, the front edge of the right side panel, the front edge of the bottom panel, and the front edge of the front top panel with a hidden fastening system. While the individual facings are meant to be applied without any additional materials other than a hidden fastening system, glue or other bonding agent can be used to attach the fascia permanently to the edges of the front top panel. For example, facings can be made permanent if the customer prefers through the application of glue or other bonding agent in the assembly process. An advantage of the disclosed cabinet system over those with facings applied in a cabinet shop or factory is that the facings can be finished with no regard for the box they will later be applied to, allowing high speed mass production and application of finish. In some examples the right side facing is indistinguishable from the left side facing, in that they can be used interchangeably, for example, by rotation. In some examples, the top facing and the bottom facing are indistinguishable and can be used interchangeably. Interchangeability of these parts greatly reduces the complexity of the cut lists and pieces needed for shipping, greatly reducing associated cost in production. Further, as facings are typically simple square (or rectangular) sticks in linear form (although some corner cabinets may have a facing that has a L shaped cross-section), the need to hand sand of most facing parts is eliminated; that is, parts can be sent through high speed mechanical sanders, robotic spray lines or vacuum finishing systems, dramatically reducing finishing costs. However, parts can still can be hand finished if the end user or customer wants to produce a custom color or look.

As disclosed herein, the individual fascia are affixed to the panels using a hidden fastening system. While the figures have focused on a particular configuration for the hidden fastening system using a Tenso fastener available from Lamello, it is envisioned that various other systems can be used in the disclosed faceless cabinet system, including the biscuit shaped connecters available from Lamello marketed as the Clamex and Tenso and available on the world wide web at lamello.com; the dowel type connectors, marketed by Hafele America Co. as found on the world wide web at hafele.com, catalogue numbers 267.20.700, 267.21.720 and 267.22.900; and Fastenlink™ connectors as available on the world wide web at fastenlink.com; Lockdowel™ products as available on the world wide web at lockdowel.com, among others conventional fastening systems.

In some embodiments, the front edge of the left side panel, the right side panel, the bottom panel, and the front top panel each comprise one or more female cabinet-fascia coupling modules. The at least two side facings and the at least one top facing and one bottom facing each may comprise one or more male cabinet-fascia coupling modules. The front edge of the left side panel, the right side panel, the bottom panel, and the front top panel each may comprise one or more male cabinet-fascia coupling modules. The at least two side facings and the at least one top facing and one bottom facing each may comprise one or more female cabinet-fascia coupling modules.

Typically, modern cabinets are predrilled with a plurality of holes for the attachment of cabinet hardware, such as shelving hangers (for example, pins), drawer guides, and hinge base plates. Thus, the left side panel and/or the right side panel may include a plurality of holes for attaching one or more drawer guides, hinge base plates, and/or locating shelves. The panels (top, bottom, and side) may also include grooves, dados, and/or rabbeting for ease of assembly and/or to attach additional cabinet members, such as fixed shelves, dividers and the like. A disclosed cabinet system further may include one or more hinge base plates, drawer guides, and/or shelf pins, which can be preattached, for example, prior to assembly of the cabinet box, or provided as separate components of the system, for example, for attachment at the work site. The cabinet system may include one or more mid-facing hangers having a front edge, rear edge and side edges, the side edges disposed between opposing faces of the left side panel and the right side panel when assembled, and one or more mid-facings, and wherein the one or more mid-facings are affixable to the front edge of the at least one mid-facing hangers with a hidden fastening system.

The one or more mid-facing hangers each may each comprise one or more female cabinet-fascia coupling modules. The one or more mid-facings each may comprise one or more male cabinet-fascia coupling modules. The one or more mid-facing hangers may each comprise one or more male cabinet-fascia coupling modules. In other embodiments the one or more mid-facings each may comprise one or more female cabinet-fascia coupling modules.

A cabinet system further may include a drawer box and drawer front, with hinges and a door. The cabinet system may further include one or more shelves.

In some embodiments, the one or more of the side facings extends over an exterior surface of the cabinet. In other embodiments, the system includes one or more side panel facing skins affixable to an exterior surface of the right side panel and or the left side panel, that when affixed, fit flush with the overhanging edge of the side facing. The ability to use a thin decorative end panel enables the use of fasteners through the sides of the box—reducing the need for dowel construction and enabling the use of simple screws or staples for construction. This enables any small woodworker or homeowner to assemble boxes inexpensively. The industry standard box (current forms) would require "camlocks" as do IKEA products. These show inside or outside the box, add cost and reduce strength.

The use of a field applicable facing and field applicable 6 mm decorative side panel facing skins allows the production of a standard generic box. This enables high speed processing, as the front edge does not need to match a door color. This reduces the number of items on a store shelf—cabinets are very big and an issue for stores to inventory. A store can thus inventory one line of boxes, and many different door and facing colors.

The freedom created by using a field applicable facing enables facings to be installed after all other work is done—reducing damage to finished surfaces. Facings can also be used as fillers—the widths can vary in order to fill the available space. Facings can be used to tie two cabinets together, creating a smooth continuous look. Retrofit of facings and doors is simple and does not require a skilled cabinetmaker. This enables the hospitality industry to update rooms using their own staff maintenance team. It allows a homeowner to freshen a kitchen—perhaps at time of sale or perhaps when he/she wants a change. It allows the replacement of damaged doors and facings relative to restaurants and store fixtures.

In some embodiments, one or more of the left side facing and/or the right side facing are configured to be affixed to a flanking cabinet boxes, thereby coupling the cabinet boxes together.

Referring generally to the figures which illustrate embodiments, of the disclosed faceless cabinet system, there are shown embodiments of a faceless cabinet system with facings or fascia that can be applied in the field, for example, during or before cabinet installation. In some embodiments, the facings are permanently affixed to the cabinet. In other embodiments, the facings are removable, replaceable, and exchangeable facings or fascia. FIG. 1 shows a cabinet system 100, which, in the embodiment shown, is a base cabinet. The cabinet system 100 includes a front top panel 110 and a back top panel 115 (although in certain embodiments the top is a single piece, for example, an upper cabinet), a left side panel 120, a right side panel 130, and a bottom panel 140. Optionally, the cabinet system 100 includes a rear panel 150, which can be a full panel, or a partial panel, for example, only extending part way up or down the back. The front top panel 110, the back top panel 115, the left side panel 120, the right side panel 130, the bottom panel 140, and the back panel 150 can be made of various materials such as wood, metal, plastic, or a combination of materials. In the embodiment shown, the left panel 120 and the right panel 130 include drawer guides 160, which can be preinstalled prior to assembly of cabinet system 100, for example, in holes predrilled into the left panel 120 and the right panel 130. The embodiment of cabinet system 100 shown also includes door hinge mounting plates 155 on the right panel 130 (although they could be on the left panel 120 or both the right and left panels 120, 130), which can also be preinstalled, for example, in predrilled holes, prior to assembly of cabinet system 100. Also shown in this view are female cabinet-fascia coupling modules 165. The female cabinet-fascia coupling modules 165 are placed on the front edges of the front top panel 110, the left side panel 120, the right side panel 130, and the bottom panel 140, so that facings with male cabinet-fascia coupling modules (not shown in this view) can be fitted to the front edges of the cabinet system 100. The female cabinet-fascia coupling modules 165 are typically inset in the front edges of the front top panel 110, the left side panel 120, the right side panel 130, and the bottom panel 140 and are approximately flush or slightly below the front edge, such that when the fascia are fit there is a minimal gap between the fascia and the edge, for a nice clean look. It is envisioned that the edges could alternatively have the male cabinet-fascia coupling modules inset therein rather than the female.

Figure 2:
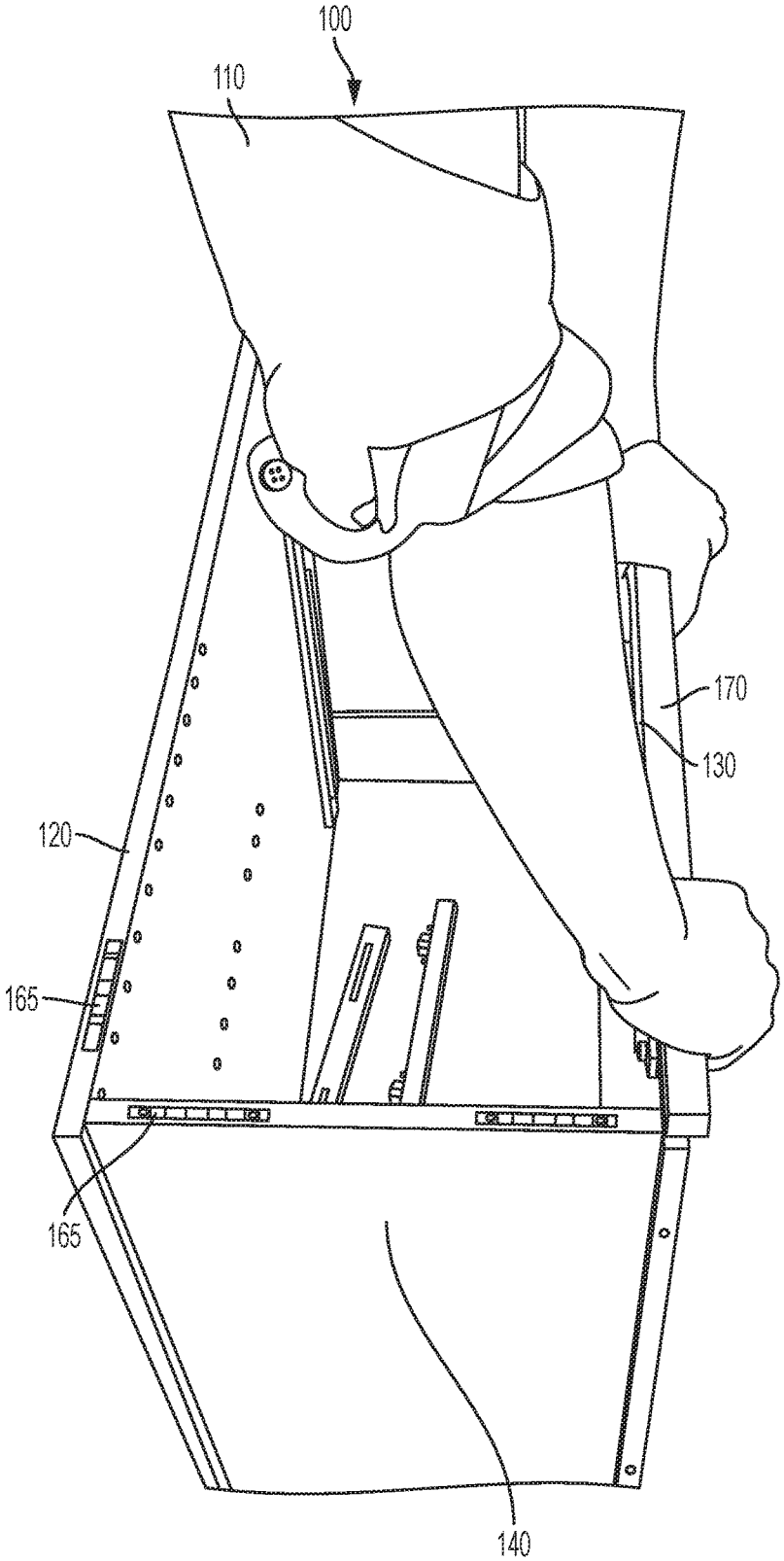
FIG. 2 is a front perspective view of a base cabinet box with a right side facing being applied to the right panel, in accordance with embodiments disclosed herein.

FIG. 2 shows cabinet system 100 onto which the right side facing 170 is being fitted onto the front edge of the right side panel 130, by insertion of the male cabinet-fascia coupling module (not visible in this view) into the female coupling module 165, for example, by aligning the male coupling module and female coupling module and applying pressure to engage the male and female coupling modules. While the fascia in the cabinet system 100 are meant to be applied without any additional materials, glue or other bonding agent can be used to attach the fascia permanently to the edges of the front top panel 110, the left side panel 120, the right side panel 130, and the bottom panel 140. Typically the right side facing 170 and/or left side facing (not shown in this view) are fitted and then the top and bottom facings (also not shown in this view) are fitted, although the exact order is not important. In some examples the right side facing 170 is indistinguishable from the left side facing, in that they can be used interchangeably, for example, by rotation. Interchangeability of these parts of the cabinet system 100 reduces the complexity of the cut lists and pieces needed for shipping, greatly reducing associated cost in production. A left side facing (not shown) can be fitted to left side panel 120 and top and bottom facings (not shown) can be fitted to front top panel 110 and bottom panel 140, respectively.

Figure 3:
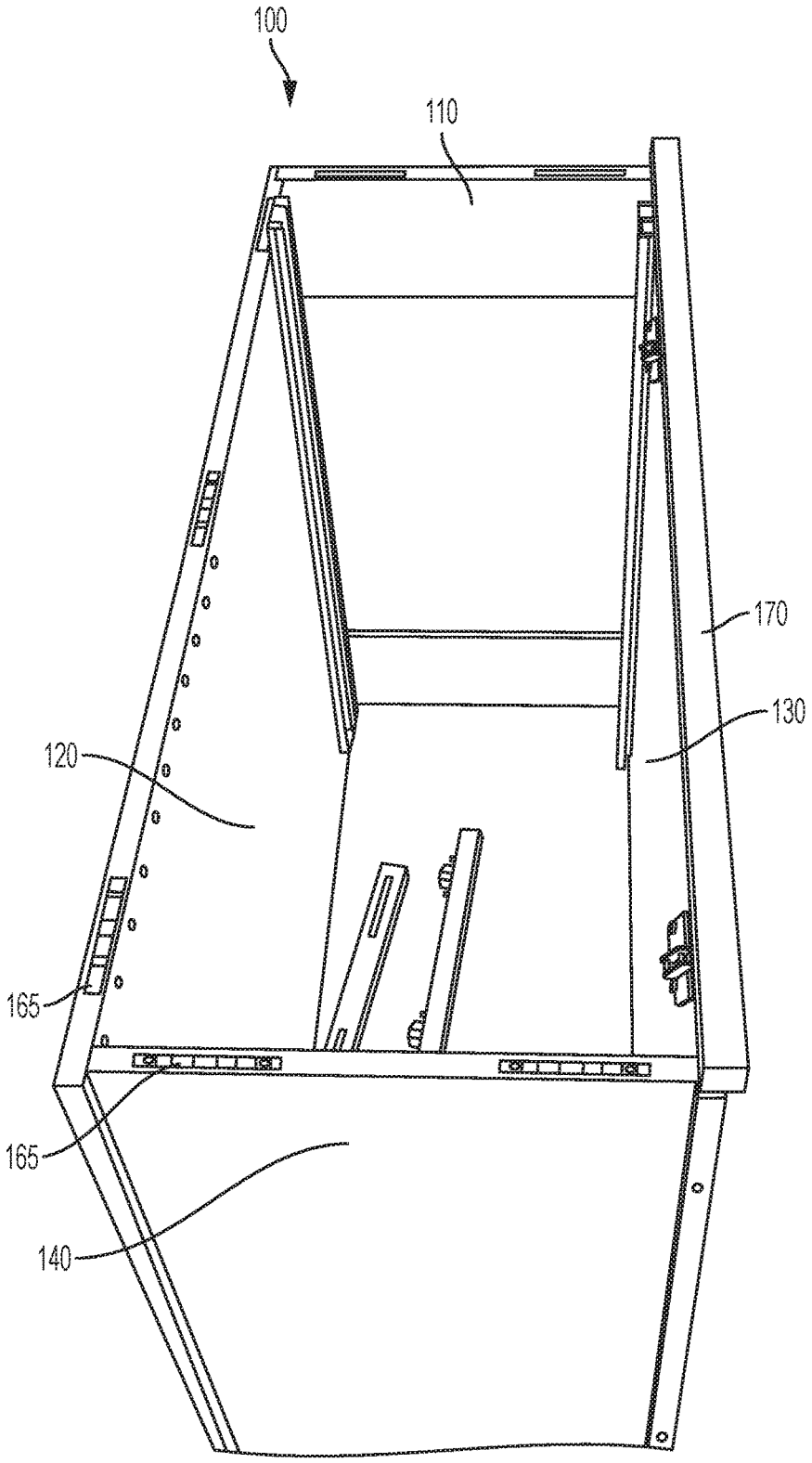
FIG. 3 is a front perspective view of a base cabinet box with a right side facing coupled to the cabinet box, in accordance with embodiments disclosed herein.

FIG. 3 shows cabinet system 100 with right side facing 170 fitted to the edge of right side panel 130. A left side facing (not shown) can be fitted to left side panel 120 and top and bottom facings (not shown) can be fitted to front top panel 110 and bottom panel 140, respectively, using the female cabinet-fascia coupling modules 165.

Figure 4:
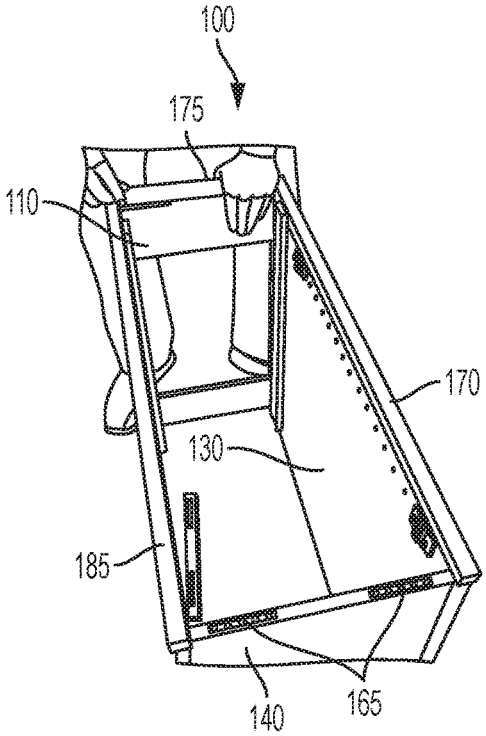
FIG. 4 is a front perspective view of a base cabinet box with an upper facing being applied to the top panel, in accordance with embodiments disclosed herein.
Figure 5:
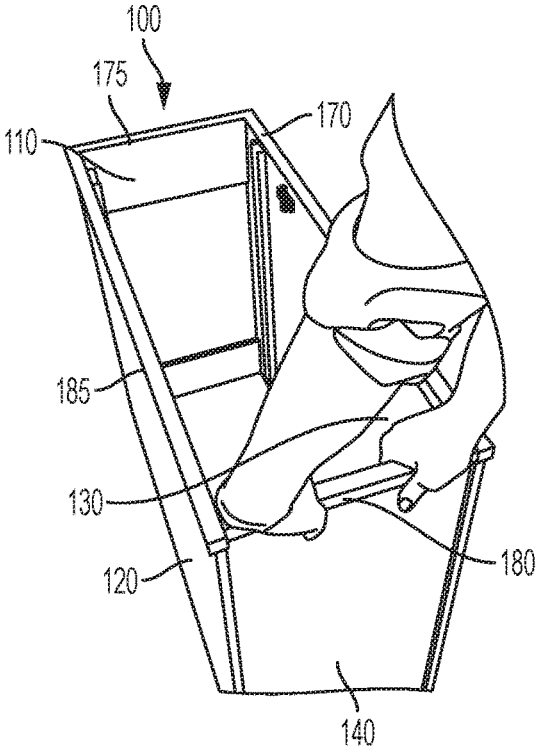
FIG. 5 is a front perspective view of a base cabinet box with a lower facing being applied to the bottom panel, in accordance with embodiments disclosed herein.

FIGS. 4 and 5 show the cabinet system 100 with the edge of the front top panel 110 and bottom panel 140 being fitted with a top facing 175 and a bottom facing 180, respectively. As with the fitting of the right side facing 170, shown in FIG. 2, coupling of the top facing 175 and the bottom facing 180 is accomplished by the insertion of the male cabinet-fascia coupling module present on the back side of the top facing 175 and the bottom facing 180 (not visible in this view) into the female cabinet-fascia coupling modules 165 present on the top front panel 110 and the bottom panel 140, for example, by aligning the male coupling module and female coupling module and applying pressure to engage the male and female coupling modules. In these views, left side facing 185 is already shown as attached to left side panel 120 and right side facing 170 is already shown as attached to right side panel 130.

Figure 6:
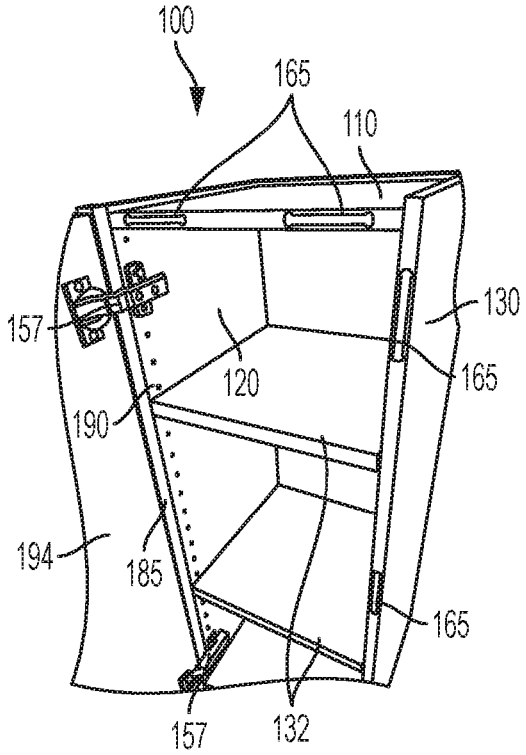
FIG. 6 is a front perspective view of a cabinet, in accordance with embodiments disclosed herein.

FIG. 6 shows the cabinet system 100, with the left side facing 185 already shown as attached to left side panel 120. In this view, no facings have as yet been mounted to the front top panel 110 or the right side panel 130. A door 194 is shown hung with hinges 157 coupled to the door hinge mounting plate 155 (not visible in this view). In this view, shelves 132 are shown as located by pins (not shown) fitted into predrilled holes 190, The female cabinet-fascia coupling modules 165 present on the top front panel 110 and the right side panel 130 are visible.

Figure 7:
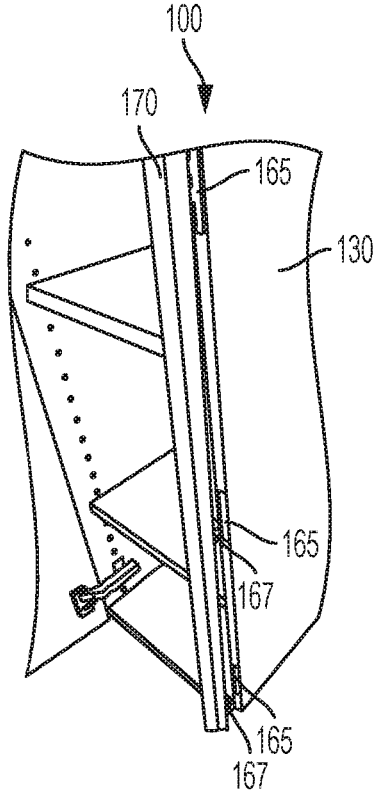
FIG. 7 is a front perspective view of a cabinet box with the left side facing in position to be mounted in place, in accordance with embodiments disclosed herein.

FIG. 7 shows the application of right side facing 175 to right side panel 130 of cabinet system 100. Right side facing 175 is affixed to right side panel 130 by alignment and insertion of the male cabinet-fascia coupling module 167 present on the back side of the right side facing 170 into the female cabinet-fascia coupling modules 165 present on the right side panel 130, for example, by applying pressure to engage the male and female cabinet-fascia coupling module 167, 165.

Figure 8:
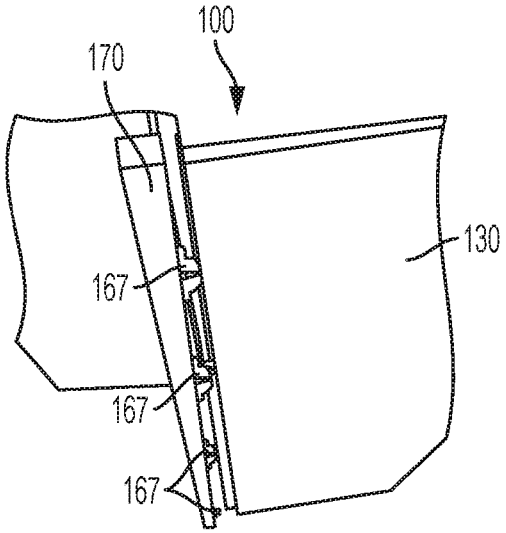
FIG. 8 is a side perspective view of a cabinet box with the left side facing in position to be mounted in place, in accordance with embodiments disclosed herein.

FIG. 8 shows the application of right side facing 175 to right side panel 130 of cabinet system 100. Right side facing 175 is affixed to right side panel 130 by alignment and insertion of the male cabinet-fascia coupling module 167 present on the back side of the right side facing 170 into the female cabinet-fascia coupling modules 165 (not visible) present on the right side panel 130, for example, by applying pressure to engage the male and female cabinet-fascia coupling module 167, 165.

Figure 9:
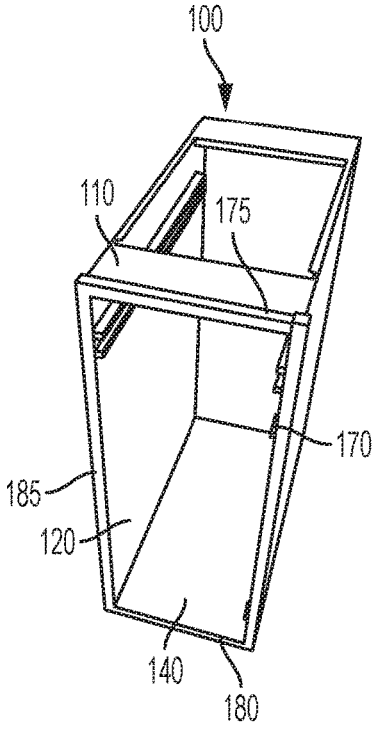
FIG. 9 is a front perspective view of a base cabinet box with the facings coupled to the cabinet box, in accordance with embodiments disclosed herein.
Figure 10:
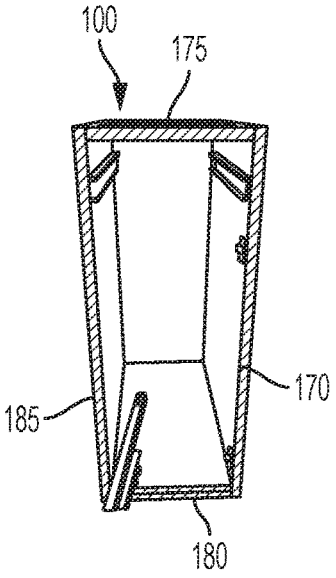
FIG. 10 is a front perspective view of a base cabinet box with alternate facings coupled to the cabinet box, in accordance with embodiments disclosed herein. [figure to be revised to show different material than FIG. 9]
Figure 11:
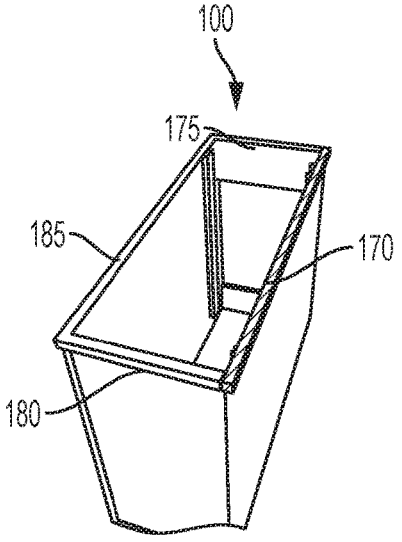
FIG. 11 is a front perspective view of a base cabinet box with facings coupled to the cabinet box, in accordance with embodiments disclosed herein. [figure to be revised to show right facing is of different material than other facings]

FIGS. 9, 10 and 11 show alternate embodiments of the cabinet system 100 with the right side facing 170, the left side facing 185, the top facing 175 and the bottom facing 180 coupled to the front edges of the right panel 120, the left panel 130, the front top panel 110 and the bottom panel 140, respectively. In FIG. 9, the right side facing 170, the left side facing 185, the top facing 175, and the bottom facing 180 are composed of the same wooden material. In FIG. 10, the right side facing 170, the left side facing 185, the top facing 175 and the bottom facing 180 are composed of the same metal material. In FIG. 11, the right side facing 170 is composed of a different material than the left side facing 185, the top facing 175, and the bottom facing 180, demonstrating that the various materials and combinations of materials can be mixed and matched for the various facings.

Figure 12:
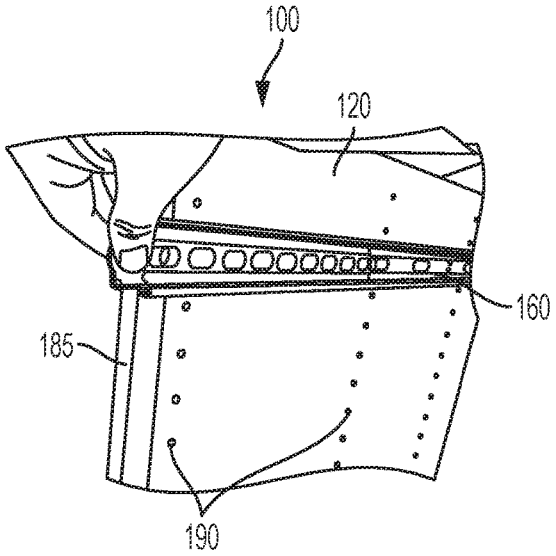
FIG. 12 is a close up interior view of a base cabinet box showing placement of the drawer guides within the cabinet box, in accordance with embodiments disclosed herein.

FIG. 12 shows a close up view of the interior of cabinet system 100, depicting the placement of the drawer guide 160 on the left side panel 120. The drawer guide 160 is coupled to the side panel 120 with fasteners located in predrilled holes 190. The spacing of the holes 190 is such that the front end of the drawer guide 160 sits approximately flush with the front edge of left side facing 185. While not shown, it is envisioned that the identical geometric configuration can be used with right side panel 130 and right side facing 170.

Figure 13:
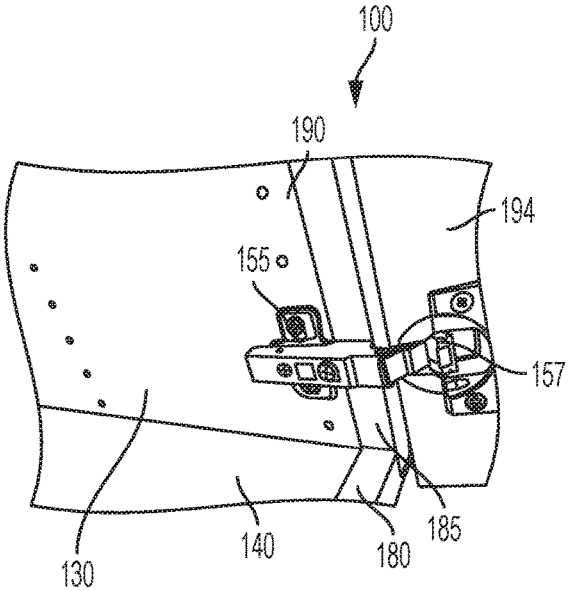
FIG. 13 is a close up interior view of a base cabinet box showing placement of the hinge mounting plates within the cabinet box, in accordance with embodiments disclosed herein.

FIG. 13 shows a close up view of the interior of cabinet system 100, depicting the placement of a conventional door hinge mounting plate 155 on the right side panel 130. Similar to the drawer guide 160 shown in FIG. 12, the door hinge mounting plate 155 is coupled to the right side panel 130 with fasteners located by predrilled holes 190. The spacing of the holes 190 is such when door 194 is hung with hinges 157 coupled to the door hinge mounting plate 155 the back face of the doors will sit approximately against the side facings 170, 185, and the facings 175, 180. As most European style hinges, such as hinges 157 have several degrees of adjustment, the placement is not overly critical. While not shown, it is envisioned that the identical geometric configuration can be used with right side panel 120 and left side facing 185. It is of course possible to use other conventional hinge systems with the depicted embodiments.

Figure 14:
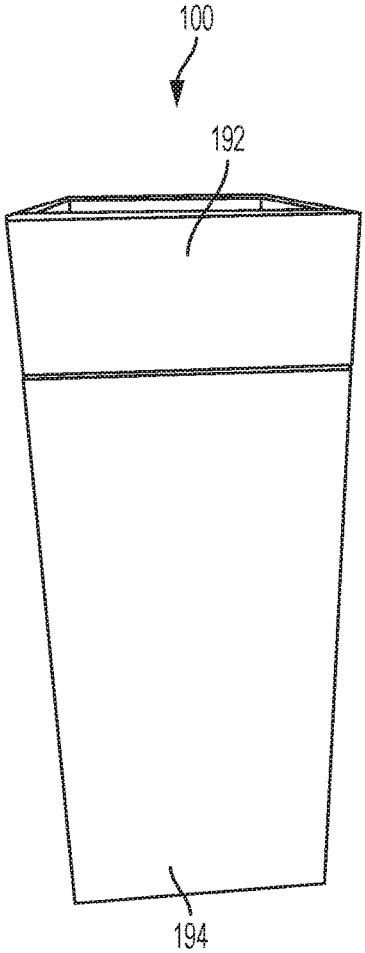
FIG. 14 is a front perspective view of a base cabinet box with a drawer front and a door front attached, in accordance with embodiments disclosed herein.

FIG. 14 shows cabinet system 100 with a drawer 192 and a door 194 attached.

Figure 15:
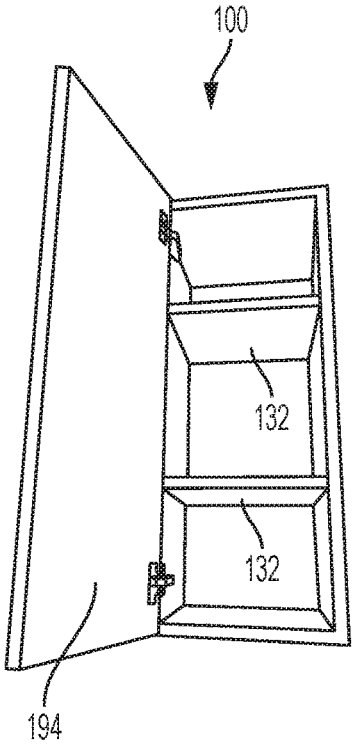
FIGS. 15 and 16 are a front perspective view of a cabinet box with a door front attached, and in FIG. 15 shelving, in accordance with embodiments disclosed herein.
Figure 16:
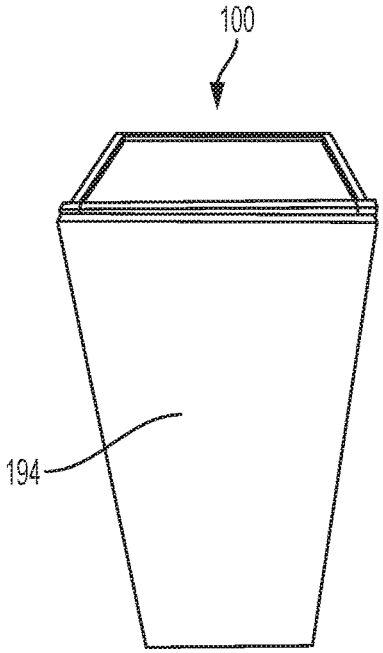

FIGS. 15 and 16 show embodiments of cabinet system 100 with a single door 194 and shelves 132.

Figure 17:
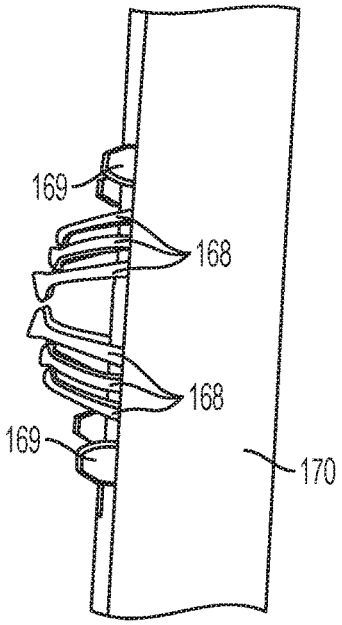
FIG. 17 is a close up of a male face coupling module inset into a facing.

FIG. 17 is a close up view of a right side facing 170 showing a conventional male cabinet-fascia coupling module 167. The male cabinet-fascia coupling module 167 includes several hooks 168, that nest within the female cabinet-fascia coupling module 165 and couple to complementary structures within the female cabinet-fascia coupling module 165. The male cabinet-fascia coupling module 167 includes tabs 169 to help align the female and male cabinet-fascia coupling module 165, 167. Examples of such fastening systems include biscuit-shaped connecters available from Lamello marketed as the Clamex or the Tenso connectors. Other conventional connectors that may be used with the depicted embodiments include dowel type connectors, such as those marketed by Hafele America Co. as found on the world wide web at www.hafele.com, catalogue numbers 267.20.700, 267.21.720 and 267.22.900. Of course, a wide variety of other conventional fasteners may alternatively be used with the depicted embodiments. It is desirable that such other fasteners be removable, but that is not a necessary feature.

Figure 18:
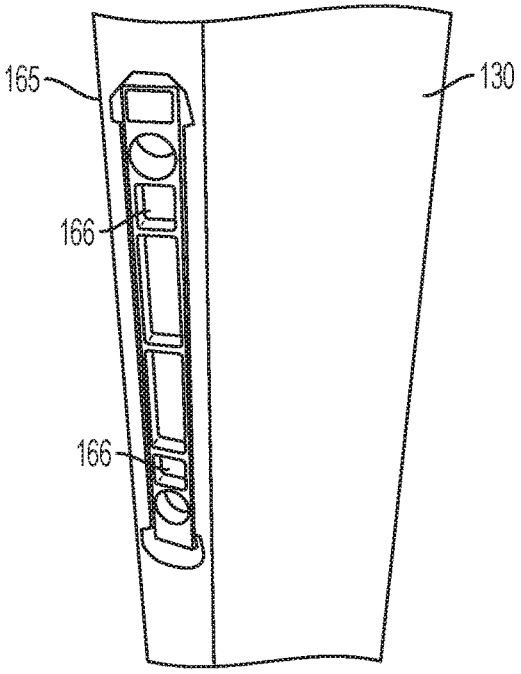
FIG. 18 is a close up of a female face coupling module inset into a facing.

FIG. 18 is a close up view of right side panel 130, with a female cabinet-fascia coupling module 165 positioned therein. Slots 166 for tabs 169 are shown.

Figure 19:
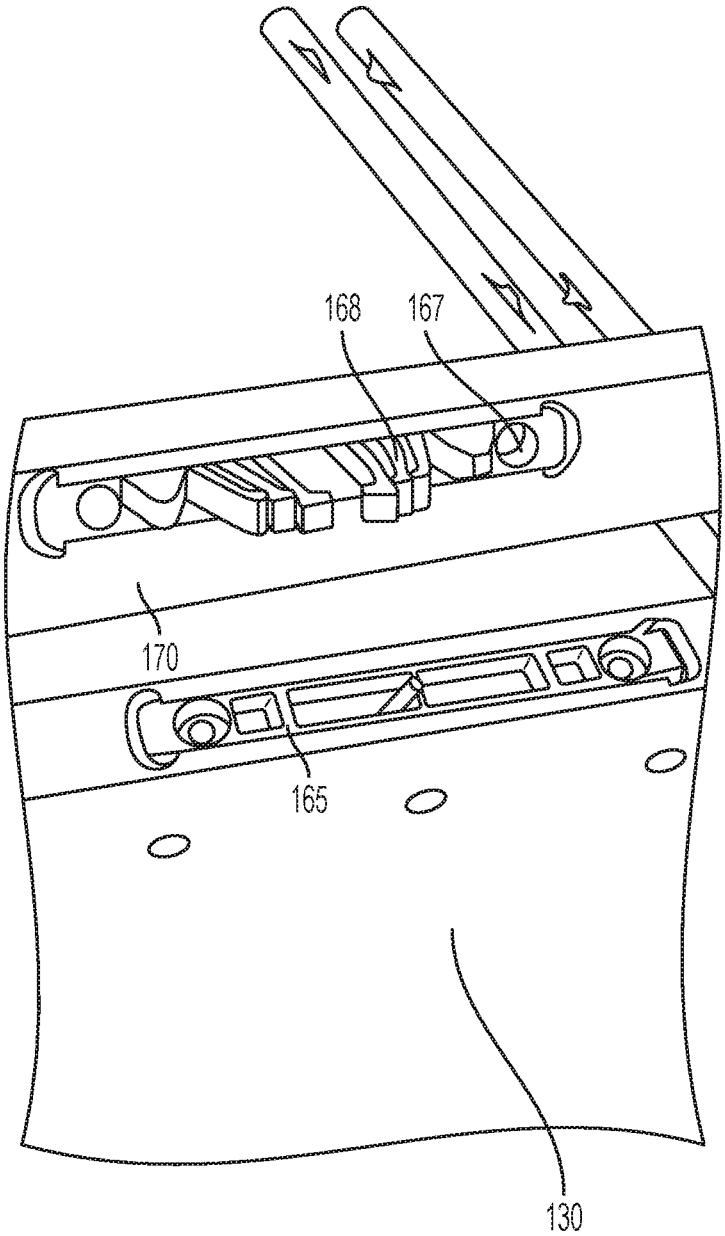
FIG. 19 is a close up of the male and female face coupling module inset into a facing and cabinet side, respectively, in accordance with embodiments disclosed herein.

FIG. 19 shows a close up view of a right side facing 170 and a right side panel 130 prior to coupling. The edge of the right side panel 130 includes the female cabinet-fascia coupling module 165, inset therein. The right side facing 170 includes the male cabinet-fascia coupling module 167 on the inner face of the right side facing 170. When the inner face of the right side facing 170 is maneuvered to engage the edge of the right panel 130, the hooks 168 extending from the male portion of the cabinet-fascia coupling module 167 nest within the female cabinet-fascia coupling module 165.

Figure 20:
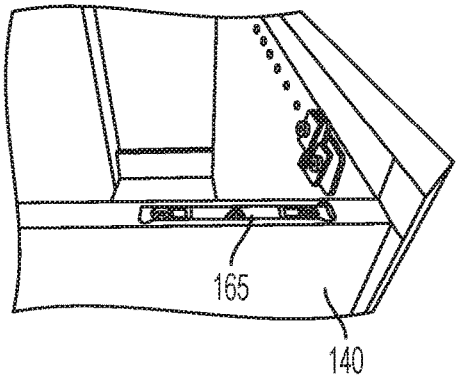
FIGS. 20-23 are close ups showing the fitting of a lower facing to a cabinet bottom panel, in accordance with embodiments disclosed herein.
Figure 22:
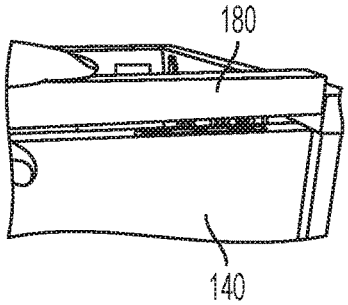
Figure 21:
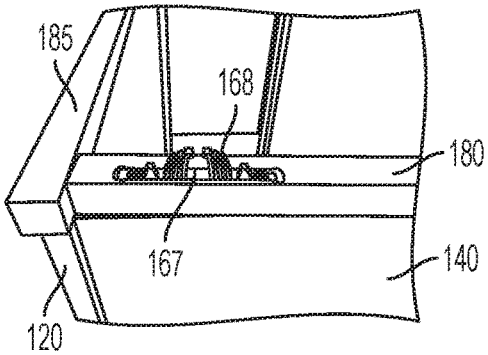
Figure 23:
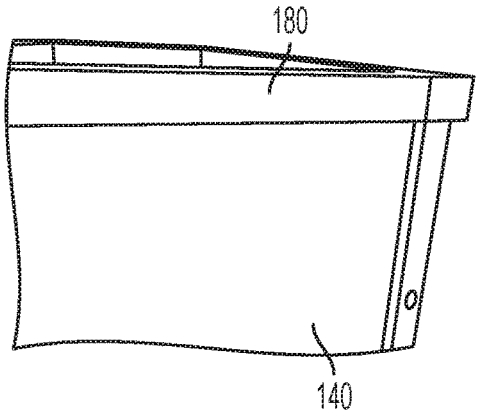

FIGS. 20-23 show a close up of the fitting of a bottom facing 180 to the bottom panel 140. FIG. 20 shows the location of the female cabinet-fascia coupling module 165. FIG. 21 shows the location of the male cabinet-fascia coupling module 167. FIG. 22 shows the insertion of the male cabinet-fascia coupling module 167 into the female cabinet-fascia coupling module 165. FIG. 23 shows the final location of the bottom facing 180 and the bottom panel 140 after coupling.

It can be best seen in FIGS. 20-23 that bottom facing 180 and left side facing 185 are of greater width than bottom panel 140 and left panel 120, respectively, to which they are mounted. This width difference can also be seen in FIG. 3 with respect to right side facing 170 and right side panel 130 and FIG. 9 with respect to top facing 175 and front top panel 110. This is because the depicted embodiment permits panels 110, 120, 130, 140 to be in the range of 10 to 13 mm thick, with 12.5 being preferred, rather than conventional panels that may be in the range of 15 to 19 mm. This substantially reduces weight and cost. By providing 12.5 mm panels with facings of 19 mm, a 6 mm decorative end panel can be used that will be flush with the outside of the facing.

Figure 24:
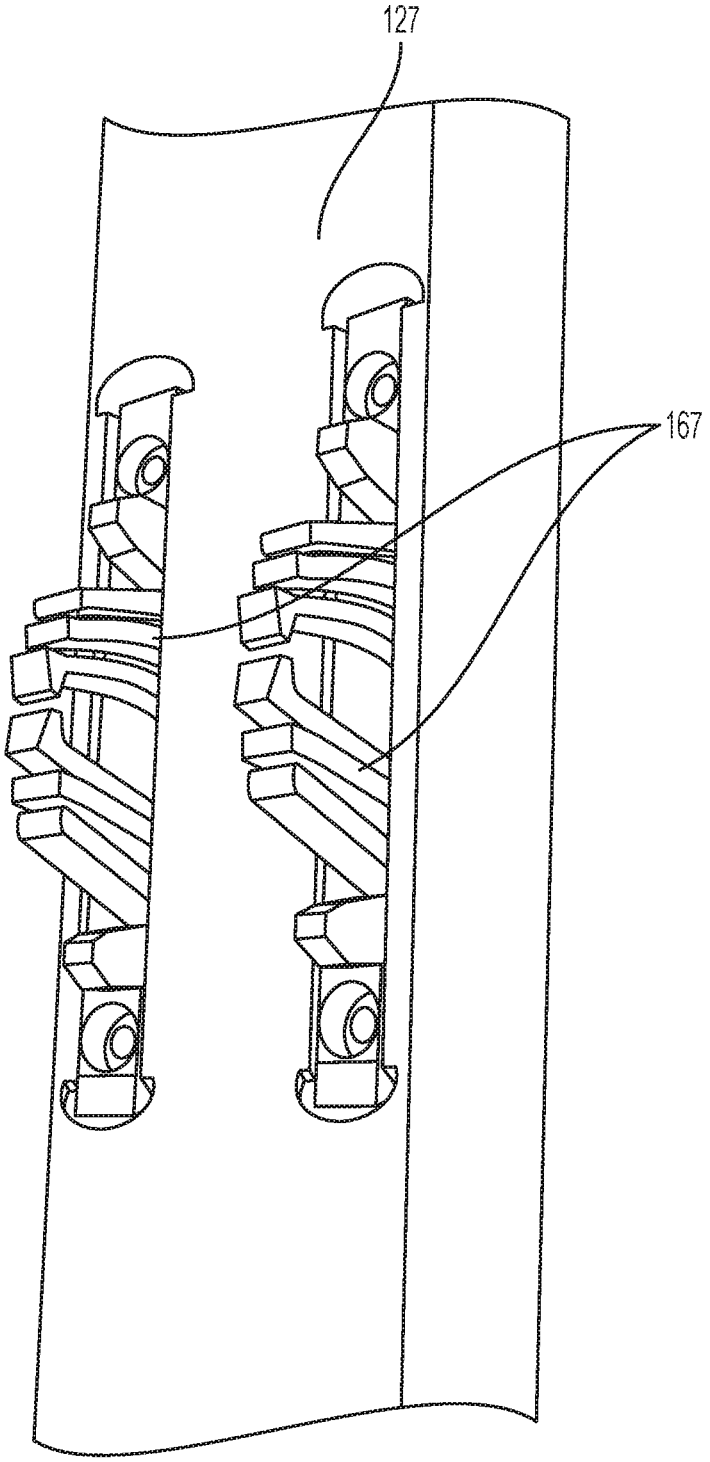
FIG. 24 is a close up of a double side facing showing the placement of two male fascia coupling modules, in accordance with embodiments disclosed herein.

FIG. 24 shows an embodiment of double side facing 127 having parallel male cabinet-fascia coupling modules 167. Double side facing 127 is designed to affix to both a left side panel 120 and a right side panel 130 simultaneously. A double side facing 127 allows for two or more cabinet boxes to be coupled or ganged together, for example, to make a run of cabinets, such as might be seen on the wall of a kitchen. Again, other permanent or removable fastening systems may alternatively be used to mount the double side facing 127.

Another aspect of one of the preferred embodiments is a cabinet system having a plurality of joined panels forming a cabinet box having a front surface, wherein the improvement comprises at least one facing and at least one door, each of which is removably mounted to the front surface in order to permit on-site replacement of facings to change the appearance of the system. In this embodiment, the facings may be applied to the cabinet box either before or after the cabinet box is mounted into place to the walls or other surfaces where it is to be positioned.

Yet another aspect of one of the preferred embodiments is a cabinet system having a plurality of joined panels forming a cabinet box including a front surface with sides having facings thereon, in which the cabinet system is formed by assembling the cabinet box off-site, and then applying the facings on-site.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope. Those with skill in the art will readily appreciate that embodiments may be implemented in a very wide variety of ways. This application is intended to cover any adaptations or variations of the embodiments discussed herein. Therefore, it is manifestly intended that embodiments be limited only by the claims and the equivalents thereof.

The invention claimed is:

1. A cabinet system, comprising:

components for a cabinet frame, the cabinet frame, when assembled, comprising:

a left side panel having a top edge, bottom edge, a front edge, and a rear edge, a right side panel, having a top edge, bottom edge, a front edge, and a rear edge opposite the left side panel, a bottom panel having a front edge, rear edge and side edges, the side edges disposed between the bottom edge of the left side panel and the bottom edge of the right side panel, a front top panel having a front edge, rear edge and side edges, the side edges disposed between the top edge of the left side panel and the top edge of the right side panel, and at least two side facings, at least one top facing, at least one bottom facing, and wherein the at least two side facings, the at least one top facing, and the at least one bottom facing are removably affixable to the front edge of the left side panel, the front edge of the right side panel, the front edge of the bottom panel, and the front edge of the front top panel with a hidden fastening system; and one or more mid-facing hangers having a front edge, rear edge and side edges, the side edges disposed between opposing faces of the left side panel and the right side panel, and one or more mid-facings, and wherein the one or more mid-facings are affixable to the front edge of the at least one mid-facing hangers with a hidden fastening system.

2. The cabinet system of claim 1, wherein the one or more mid-facing hangers each comprise one or more female cabinet-fascia coupling modules.

3. The cabinet system of claim 1, wherein the one or more mid-facings each comprising one or more male cabinet-fascia coupling modules.

4. A cabinet system, comprising:

components for a cabinet frame, the cabinet frame, when assembled, comprising:

a left side panel having a top edge, bottom edge, a front edge, and a rear edge, a right side panel, having a top edge, bottom edge, a front edge, and a rear edge opposite the left side panel, a bottom panel having a front edge, rear edge and side edges, the side edges disposed between the bottom edge of the left side panel and the bottom edge of the right side panel, a front top panel having a front edge, rear edge and side edges, the side edges disposed between the top edge of the left side panel and the top edge of the right side panel, and at least two side facings, at least one top facing, and at least one bottom facing, and wherein the at least two side facings, the at least one top facing, and the at least one bottom facing are removably affixable to the front edge of the left side panel, the front edge of the right side panel, the front edge of the bottom panel, and the front edge of the front top panel with a hidden fastening system; and wherein one or more of the left side facing or the right side facing are configured to be affixed to a flanking cabinet boxes, thereby coupling the cabinet boxes together.

5. The cabinet system of claim 4, further comprising a back panel having side edges, the side edges disposed between the rear edge of the left side panel and the rear edge of the right side panel.

6. The cabinet system of claim 4, wherein the facings are wider than the panels to which they are affixed.

7. The cabinet system of claim 4 wherein the facings are removably mounted to the front surface of the cabinet box on-site.

8. The cabinet system of claim 4 wherein the facings are applied to the cabinet box after the cabinet box is mounted into place.

9. The cabinet system of claim 4 wherein the one or more of the left side facing or the right side facing are removably affixed by a fastening system including two adjacent male and two adjacent female coupling modules.

* * * * *